US006484554B2

(12) United States Patent
Soyk

(10) Patent No.: US 6,484,554 B2
(45) Date of Patent: Nov. 26, 2002

(54) PORTABLE LIFT AND STRAIGHTENING PLATFORM

(75) Inventor: Melvin A. Soyk, Grand Island, NE (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/885,823

(22) Filed: Jun. 20, 2001

(65) Prior Publication Data

US 2001/0049957 A1 Dec. 13, 2001

Related U.S. Application Data

(63) Continuation of application No. 09/593,032, filed on Jun. 13, 2000, now Pat. No. 6,269,676.

(51) Int. Cl.[7] ..... B21J 13/00
(52) U.S. Cl. ..... 72/447; 72/457; 72/705
(58) Field of Search ..... 72/447, 457, 705

(56) References Cited

U.S. PATENT DOCUMENTS

| | | | | | |
|---|---|---|---|---|---|
| 3,340,720 | A | * | 9/1967 | Chartier | 72/705 |
| 3,689,030 | A | * | 9/1972 | Backus | 72/705 |
| 3,835,693 | A | | 9/1974 | Majersky | |
| 4,151,737 | A | | 5/1979 | Specktor | |
| 4,336,705 | A | | 6/1982 | Specktor | |
| 4,398,410 | A | | 8/1983 | McWhorter et al. | |
| 4,501,136 | A | * | 2/1985 | Celette | 72/705 |
| 4,574,614 | A | | 3/1986 | Field | |
| 4,823,589 | A | | 4/1989 | Maxwell, Jr. et al. | |
| 5,016,465 | A | | 5/1991 | Papesh | |
| 5,186,038 | A | | 2/1993 | Venalainen | |
| 5,239,854 | A | * | 8/1993 | Hinson | 72/705 |
| 5,251,013 | A | | 10/1993 | Danielson et al. | |
| D346,255 | S | | 4/1994 | Francis et al. | |
| 5,355,711 | A | | 10/1994 | Chisum | |
| 5,644,946 | A | | 7/1997 | Weschler | |
| 5,724,853 | A | * | 3/1998 | Johansson | 72/705 |
| 5,801,834 | A | | 9/1998 | Danielson et al. | |
| 6,000,272 | A | | 12/1999 | Hinson | |

FOREIGN PATENT DOCUMENTS

| | | |
|---|---|---|
| IT | 93U000014 | 4/1993 |

OTHER PUBLICATIONS

Spanesi Iberica, S.L. Mini Bench brochure (Automechanika 1996).
RosAuto Mini Tir Straightening Bench brochure.
Chief Automotive Systems Streamline Productivity brochure (1999).
Celette La Vega brochure (1996).
Dymax x–100 (copy of brochure).
Iyasaka System Car–O–Liner Mini Bench brochure (1997).

* cited by examiner

*Primary Examiner*—Ed Tolan
(74) *Attorney, Agent, or Firm*—Hovey Williams LLP

(57) ABSTRACT

An automobile lift and straightening platform is useful for performing repairs on motor vehicles received thereon, and includes a base, a bench which includes treadways for permitting the vehicle to roll thereon and receiving anchors for coupling the vehicle body to the bench, a lifting unit for raising and lowering the bench relative to the base, and a locking unit for locking the bench in an elevated position relative to the base and thereby inhibiting undesired lowering of the vehicle. An unlocking member is provided which may be actuated by the foot of the worker. A hand held control is connected to a power unit for operating an extensible ram of the lifting unit to raise and lower the bench, thus permitting one worker to lower the bench when simultaneously actuating the control and the unlocking member. The platform receives a pulling assembly which is more readily aligned and coupled to the bench by the provision of for and aft suspension assemblies which permits assisted tilting of the pulling assembly to insert a tongue of the pulling assembly into a receiver on the bench.

16 Claims, 6 Drawing Sheets

PORTABLE LIFT AND STRAIGHTENING PLATFORM

RELATED APPLICATION

This is a continuation of application Ser. No. 09/593,032 filed Jun. 13, 2000, now U.S. Pat. No. 6,269,676.

BACKGROUND OF THE INVENTION

1. Field of the Invention

This invention relates to a platform for lifting automobiles for use in small repair facilities requiring the platform to be readily moved and capable of one person operation. More particularly, it is concerned with a lifting platform capable of receiving pulling towers in a multiplicity of different locations for straightening an automobile chassis and body with enhanced ease of use.

2. Description of the Prior Art

Automobiles involved in collisions often require extensive body work to return the automobile to its original body alignment. The work often includes the use of strategically positioned pulls on the chassis and/or body to straighten the chassis. This technique of straightening is well known in the art, but until recently has required large, heavy platforms to support the automobile and withstand the pulling forces. These platforms are very useful, but because of their size and expense have been limited to larger and more specialized body shops which have sufficient size and volume of repair work to justify the space and expenditure of large platforms. Smaller repair shops could not devote the space, funds, or manpower necessary to utilize such large platforms. In addition, larger repair shops would benefit from a lighter platform which could be readily moved and used for work not involving high force pulls.

More recently, various efforts to providing a smaller repair platform have been initiated. These platforms have been generally small scissor lifts designed to have a lifting tower coupled at one location on the platform. Their configuration thus has limited capability in regard to the pulling force or direction which may be applied to the automobile. Moreover, these existing platforms are not designed to permit drive-on/drive-off capabilities, making usage more difficult for a single individual.

There has thus developed a need for a small, economical repair platform which not only lifts the vehicle to permit access to the undercarriage and usage for purposes other than body straightening, but also accommodates the needs of the small repair shop for improved positioning of pulling towers and facilitates one-person usage.

SUMMARY OF THE INVENTION

These objects have largely been met by the present invention which enables a worker to quickly and easily position the automobile on the platform, position a pulling tower, and raise and lower a deck on which the automobile is supported without additional assistance. Moreover, the platform permits the automobile to be driven onto the platform into a predetermined position, and then driven off. Moreover, the platform includes as a safety feature a locking bar assembly which prevents unintended lowering of the deck unless the worker performs two simultaneous operations.

Broadly speaking, the automobile lift and straightening platform of the present invention includes a base, a lifting assembly, a bench having a pair of drive-on decks, a locking assembly, and optionally, or at different times during the course of use, a pulling assembly which may be mounted to the bench or to an extension, and runways having ramps to permit a vehicle to drive onto the deck. The runways may be coupled to the base and detachably receive ramps and chocks thereon so that the automobile may be driven on to the deck until stopped by the chocks at a predetermined position, and then backed off or alternatively the ramps may be repositioned in place of the chocks whereby the automobile may be driven in the same direction.

Moreover, the bench and extension present a multiplicity of receivers for enabling attachment of a pulling assembly including a tower to the platform, thereby providing improved pulling force capability as the tower or towers need not tilt in order to be positioned opposite a damaged portion of the vehicle and then to pull from the desired location relative to the vehicle. Further, the configuration of the bench makes it possible for more than one tower to be employed for simultaneous pulling at multiple locations. The tower thus retains the same pulling power at different elevations relative to the bench or extension. The tower preferably includes a spring assist in regard to its height above the supporting surface, whereby the tower may be more easily attached to a receiver. The deck is configured to receive anchoring stands for coupling the automobile to the deck. Thus, the automobile may be driven onto the deck, coupled thereto by the anchors, and then be raised, such that for the large majority of automobiles and trucks, there is no need to lift either the automobile or the deck prior to coupling.

In order to facilitate operation by a single worker, the platform hereof includes removable wheel assemblies and a trolley which may be mounted to the platform for moving by a single person. The locking assembly is gravity actuated and prevents the deck from undesired lowering relative to the base, and an unlocking arm actuated by a foot pedal permits the worker to actuate a hand control to lower the deck while using his foot to disengage the locking assembly. Thus, lowering of the deck requires two independent operations which may be performed by a single person, thereby making it unlikely that the deck will be unintentionally lowered until ready.

These and other features will be readily apparent to those skilled in the art with reference to the drawings and the following description of the preferred embodiment.

DESCRIPTION OF THE PREFERRED EMBODIMENT

Figure 1:
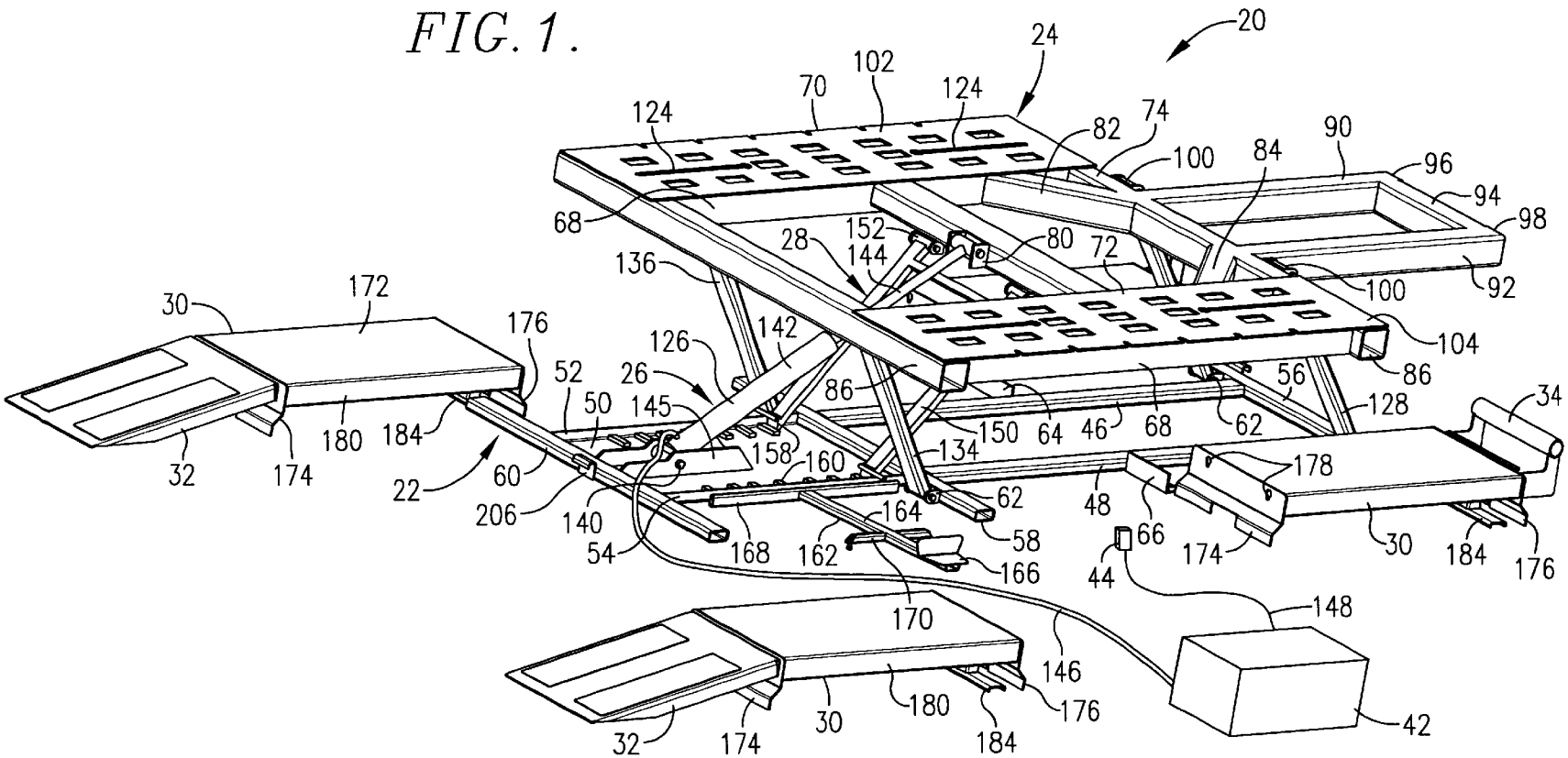
FIG. 1 is a left rear perspective view of the automobile lift and straightening platform of the present invention, showing the deck elevated relative to the base and the ramps and chocks in position on the runways.

Referring now to the drawing, a portable lift and straightening platform used in the repair of automobiles in accordance with the present invention broadly includes a base 22, a bench 24, and a lifting unit 26, and a locking unit 28. Optionally or at different times during the use of the platform 20, runways 30 having ramps 32 or chocks 34, a transport unit 36, a pulling assembly 38, and an extension 40 may be connected to the bench 24. The lifting unit 26 further includes a power unit 42 and a control 44 for controlling use of the power unit 42.

In greater detail, the base 22 is designed to rest upon the floor of a garage or the like and has a pair of parallel, spaced, elongated and longitudinally extending tubular base bars 46 and 48, a rear pan 50 having parallel, spaced, elongated and longitudinally extending pan bars 52 and 54 on either side of the pan 50, a front tube 56, a middle tube 58, and a rear tube 60 all connected by welding. The front tube 56 and middle tube 58 each include a pair of laterally spaced lower swing mounts 62. The longitudinally extending tubular base bars 46 and 48 also each have respective diverging, laterally extending support angle members 64 and 66 which serve to stabilize and support the bench 24 when the latter is in a lowered position.

The bench 24 includes four substantially parallel longitudinally extending stringers 68, two of the stringers 68 being relatively more closely spaced along each side to support thereon decks 70 and 72. Front channel 74, middle channel 76 and rear channel 78 are welded to and extend transversely and substantially normal to the stringers 68, the middle channel 76 including a centrally located pivot bracket 80, and braces 82 and 84 are welded to stringers 68 and front channel 74. The front channel 74 and rear channel 78 are open at their ends to provide receivers 86. A front tower mount 88 extends forwardly from front channel 74 having channel beams 90 and 92 extending longitudinally and a cross beam 94 connecting the beams 90 and 92 at their forward ends 96 and 98 to provide receivers 86 therein as well. The front channel 74 and rear channel 78 also include laterally spaced upper swing mounts 100.

The decks 70 and 72 define longitudinally extending treadways 102 and 104 which are parallel to one another. The treadways 102 and 104 each include a top plate 106 supported on the channels 74, 76 and 78 and stringers 68, and a bottom plate 108, visible in FIG. 8, spaced below the top plate 106 about the thickness of the tubular channels and stringers. Laterally spaced and longitudinally extending guides 110 and 112 are welded between the plates 106 and 108 to define a track 114 and receive for slidable movement therealong anchor blocks 116. The anchor blocks 116 are provided with a threaded hole 118, two anchor blocks 116 being located in each track 114. The top plates 106 include a number of rectangular openings 120 which may receive therein chains or vehicle anchors. Additionally, the top plates 106 have longitudinally extending slots 122 each having an enlarged keyway 124. The anchor blocks 116 receive threaded fasteners to couple vehicle anchors thereto, the vehicle anchors being adapted to clamp the pinch welds along the rocker panels of automobile bodies or otherwise fasten to an automobile body to facilitate working on the vehicle when the wheels are removed. The treadways 102 and 104 are preferably shorter longitudinally than the wheelbase of most automobiles, whereby when an automobile is driven onto the bench 24, its wheels will be forward and rearward of the treadways.

Figure 4:
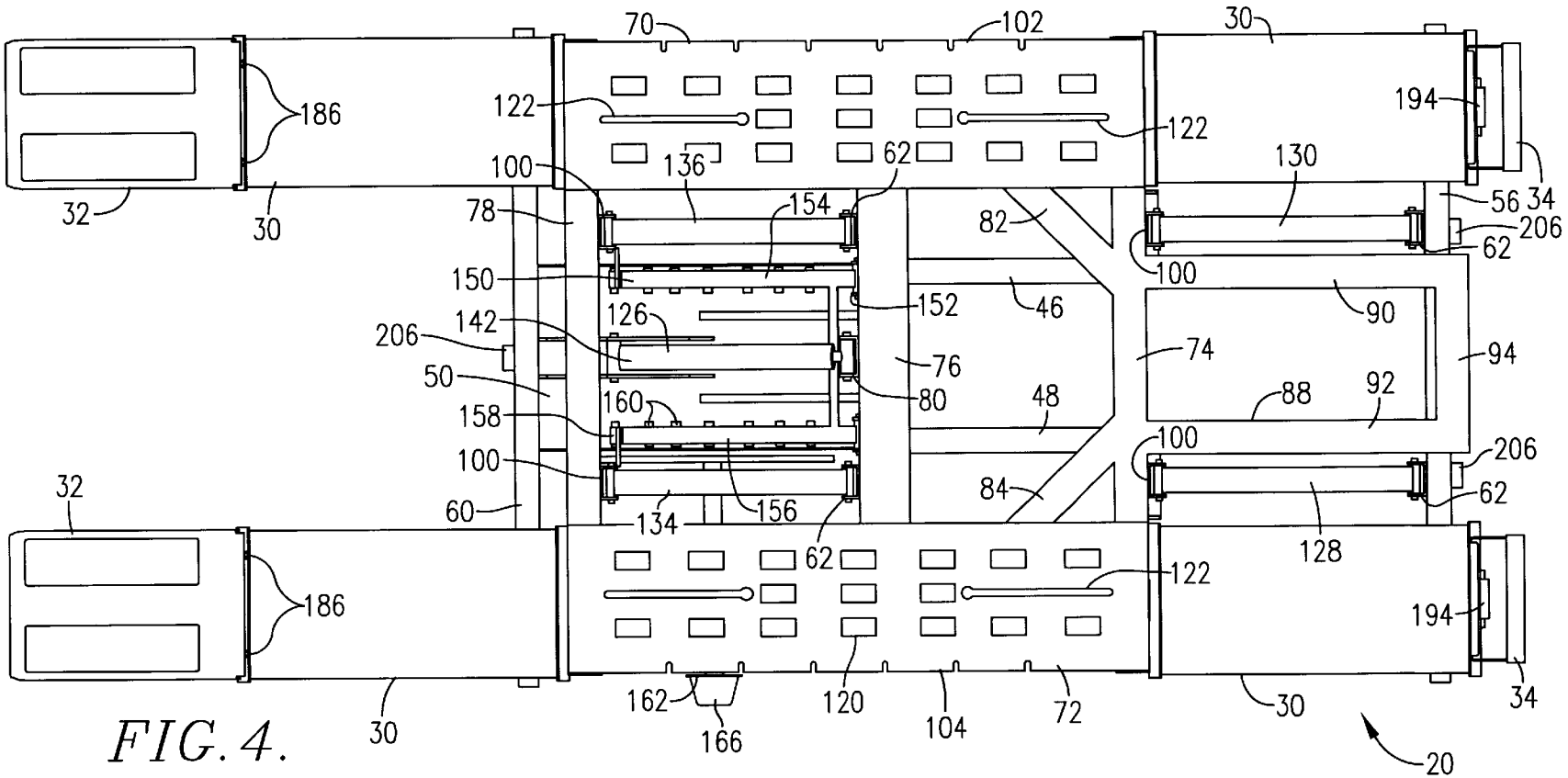
FIG. 4 is a top plan view of the platform of the platform of the present invention showing the location of the deck relative to the runways when in a lowered position.
Figure 5:
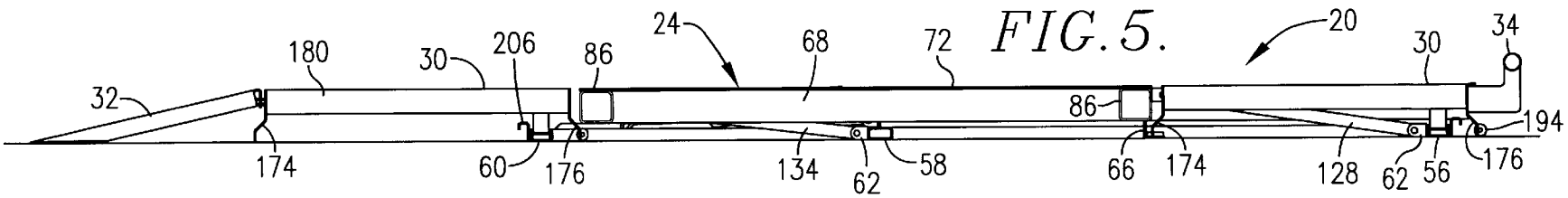
FIG. 5 is a left side elevational view of the platform of the present invention shown in a lowered position.
Figure 6:
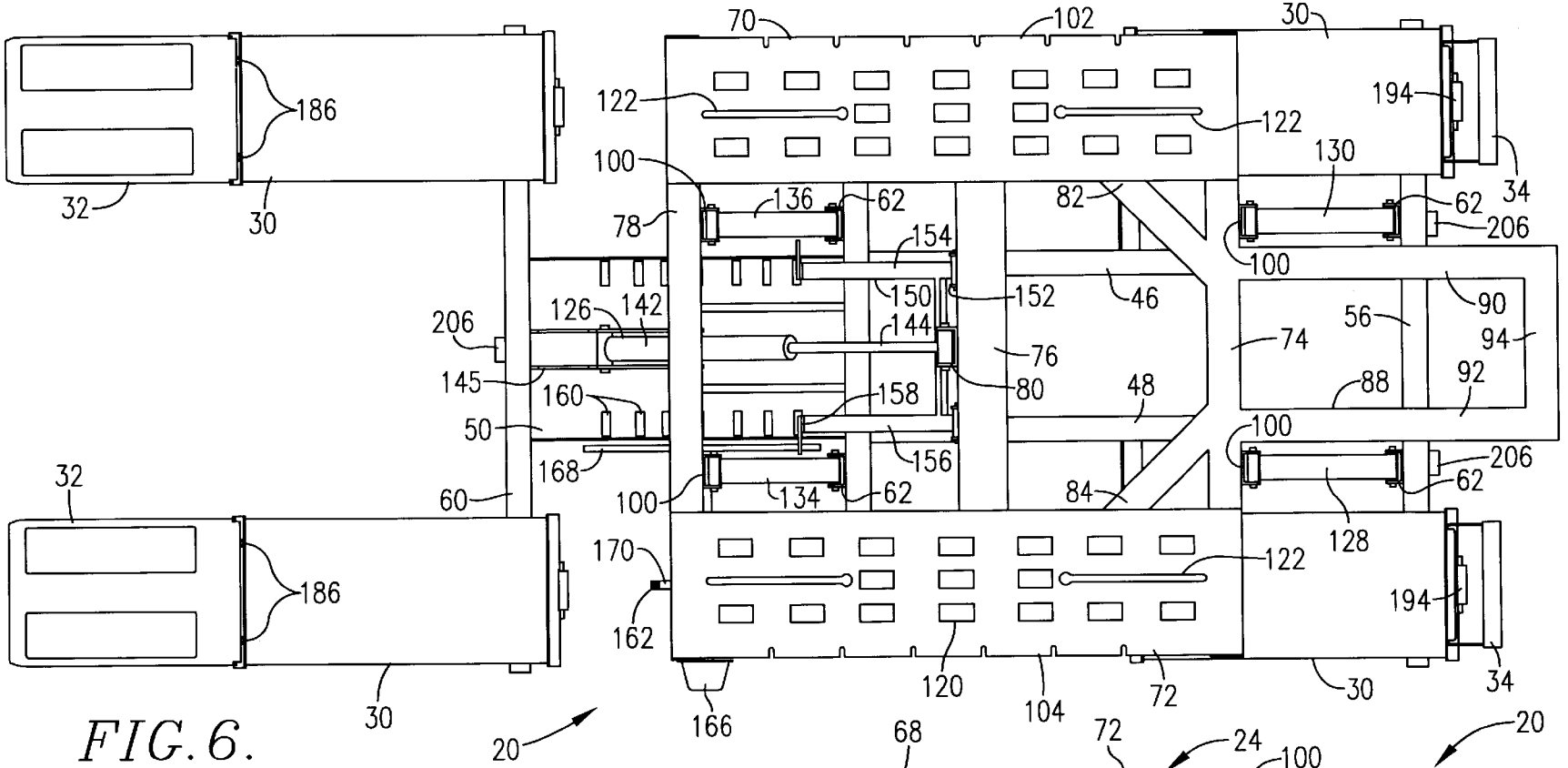
FIG. 6 is a top plan view of the platform of the present invention showing the deck in an elevated position.
Figure 7:
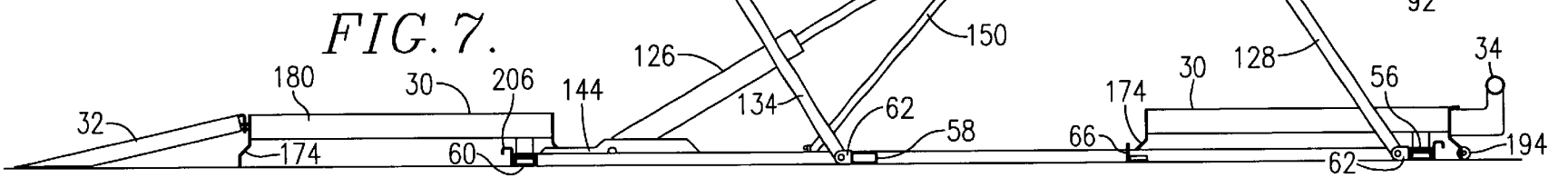
FIG. 7 is a left side elevational view thereof.

The lifting unit 26 interconnects the base 22 and the bench 24. The lifting unit 26 includes, as well as the power unit 42 and the control 44, an extensible member 126, front swing arms 128 and 130, and rear swing arms 134 and 136. The front swing arms 128 and 130 are slightly longer than rear swing arms 134 and 136, each including a swing bearing 138 at each end. For example the front swing arms 128 and 130 are slightly more than 31 inches, while the rear swing arms are slightly less than 29 inches. The swing bearings 138 connect to the swing mounts 62 and 100 on the base 22 and bench 24, respectively, by pivot pins 140 to permit the bench 24 to swing upwardly between the lowered position shown in FIGS. 4 and 5 to the raised position shown in FIGS. 1, 2 and 7. The extensible member 126 is shown as a single action hydraulic ram, but double acting rams or screw driven rams would also be useful. The extensible member has a housing 142 and an extensible arm 144, the latter being pivotally coupled to the pivot bracket 80 by a pivot pin 140, while the housing 142 is pivotally connected to shoe 145 by a pivot pin 140. The shoe 145 is welded to the pan 50. The power unit 42 is an electrically powered low pressure hydraulic pump which is connected to the housing 142 by hydraulic conduit 146 and powered by conventional 110 or 230 volt electrical current. The control 44 is hand-held and electrically connected to the power unit 42 by a length of electrical cord 148 and has a switch for selectively actuating the power unit 42 to extend or retract the extensible arm 144. The conduit 146 is of sufficient length to position the power unit out of the way of the worker doing repairs, and the electrical cord 148 is of sufficient length to permit the worker to position himself around the vehicle for peak visibility and safety.

The locking unit 28 includes a lock arm assembly 150 pivotally coupled to the middle channel 76 by a pair of lock arm brackets 152 on either side of pivot bracket 80, with pivot pins 140 pivotally connecting bearings on the upper end of the lock arm assembly 150 to the lock arm brackets 152. The lock arm assembly includes laterally spaced lock bars 154 and 156 which are influenced by gravity to swing downwardly. The lower ends of the lock bars 154 and 156 each have feet 158 configured to ride over a plurality of longitudinally spaced lock teeth 160, which are welded to the pan 50 and pan bars 52 and 54, when the bench 24 is moving upwardly relative to the base 22. Conversely, the feet 158 engage and hold fast against the lock teeth 160 when the bench 24 when static or under a downward load on the bench 24. An unlocking member 162 is provided for selectively lifting the feet 158 clear of the lock teeth 160 to permit the bench 24 to be lowered. The unlocking member 162 includes an arm 164 normally transverse to the longitudinal axis of the pan bars 52 and 54, a foot pedal 166 at the outboard end of the arm 164, an elongated trip bar 168 extending longitudinally a length corresponding to the longitudinal extension of all of the lock teeth 160, and a rocker 170 positioned intermediate the foot pedal 166 and the trip bar 168 and preferably more proximate the former. The rocker 170 extends below the bottom of the arm 164 to provide a fulcrum and pivot axis for the unlocking member 162. The length of the arm 164 and the position of the rocker 170 are sufficient so that when the worker steps on the foot pedal 166, the trip bar 168 engages one of the feet 158, which thereby lifts both feet 158 upwardly above the lock teeth 160. The trip bar 168 is relatively smooth and uninterrupted along its upper surface, such that the engaged foot 158 is able to slide along the trip bar 168 above the lock teeth 160 as the bench 24 is lowered.

Runways 30 have a deck 172 which is substantially as wide as the width of each top plate 106. The deck 172 is elevated by stands 174 and 176 to be substantially the same height and substantially coplanar to each of the treadways 102 and 104 when the bench is in a lowered position. Each runway includes keyholes 178, a pair of longitudinally extending rails 180, end plates 182 which includes the keyholes and extends from the stands, and key 184. The keyholes 178 are adapted to receive the heads of ramp mount bolts 186 for securing the ramps 32 to the stands 174 in an inclined orientation. The end plates 182 adjacent stand 176 and opposite stand 174 are configured to receive therein the heads of coupling bolts 188 for securing the chocks 34 thereto. The chocks 34 include a pair of upright stanchions 190 and crossbar 192 for engaging the tire of a vehicle. A roller 194 is provided on at least one of the stands 174 and 176 to facilitate movement of the runway 30. The transverse keys 184 fit within the ends of the tubes 56 and 60 to inhibit undesired movement of the runways 30 relative to the base 22.

Figures 9, 10, 11, 12:
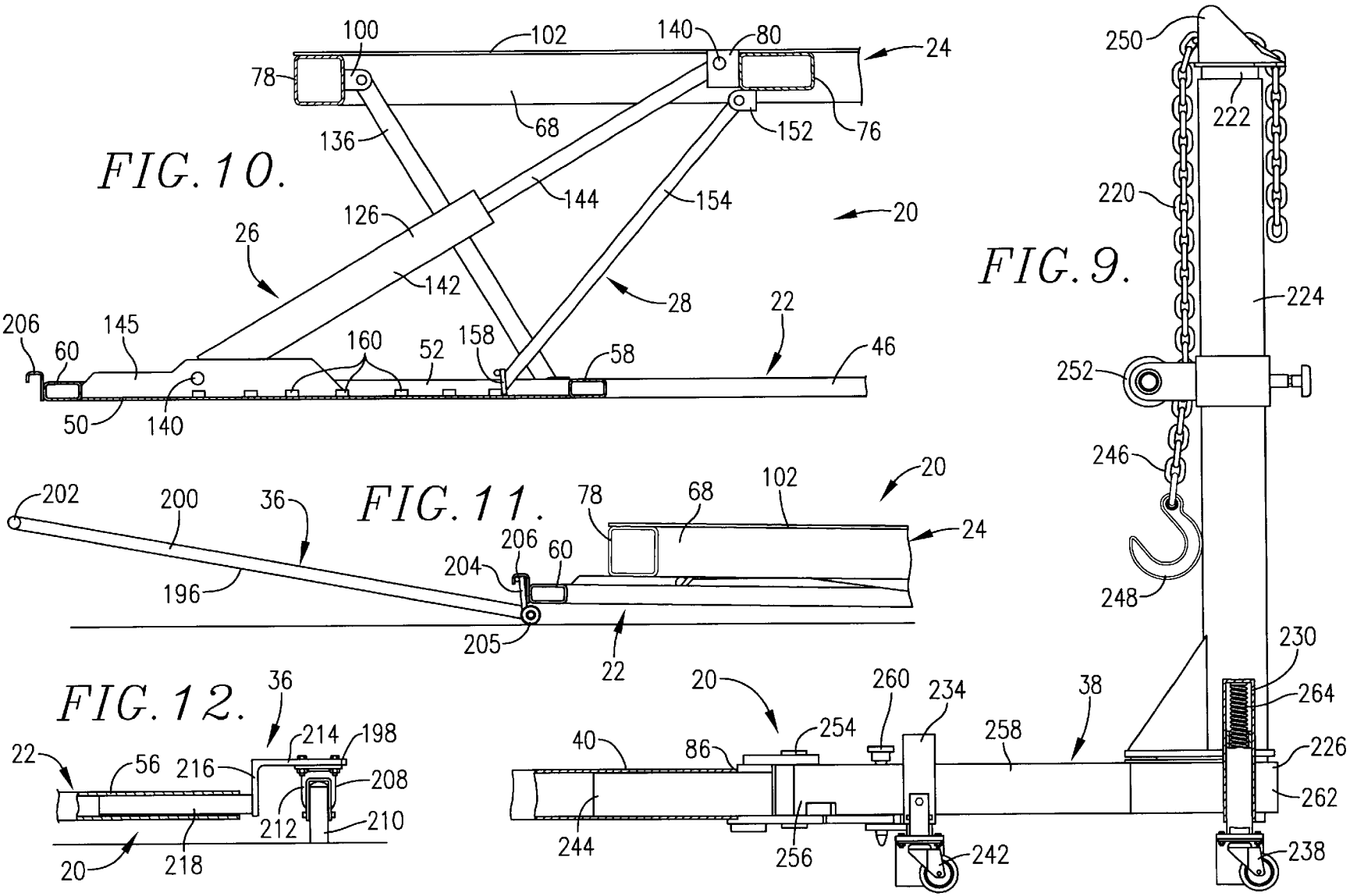
FIG. 9 is an enlarged, fragmentary side elevational view of the platform showing a pulling tower coupled to the pulling extension as illustrated in FIG. 8.
FIG. 10 is a fragmentary vertical sectional view taken longitudinally through the platform hereof, showing the upper and lower cylinder mount and rear lift arms in an elevated position.
FIG. 11 is a fragmentary side elevational view of the rear of the platform showing attachment of a transport trolley for moving the platform after the attachment of the wheel assemblies.
FIG. 12 is a fragmentary elevational view in partial section through a channel of the base showing one of the wheel assemblies mounted to a runway receiver.

The transport unit 36 includes a transport trolley 196 and a plurality of wheel units 198. The transport trolley 196 as shown in FIG. 11 has an elongated pullbar 200 with a handle 202 at one end and a lifting flange 204 at the other end, the lifting flange being angularly oriented relative to the pullbar 200. A pair of spaced trolley wheels 205 aid in not only transporting the 20, but also serve as a fulcrum whereby downward force on the handle 202 causes the lifting flange 204 to pivot upwardly against a lip 206 welded to the rear tube 60. The wheel units 198, as seen in FIG. 12, include a wheeled caster 208 which includes wheels 210 and a yoke 212. The caster 208 permits the wheels 210 to rotate about a horizontal axis. The wheeled caster 208 is mounted on an angle member 214 having an upright wall 216 with a foot 218 extending horizontally therefrom, the foot being complementally configured with the ends of the front tube 56, the middle tube 58 and the rear tube 60 whereby the foot 218 may be inserted into the ends of each of the tubes 56, 58 and 60 to support the base and permit the platform 20 to be transported to a different location.

Figure 8:
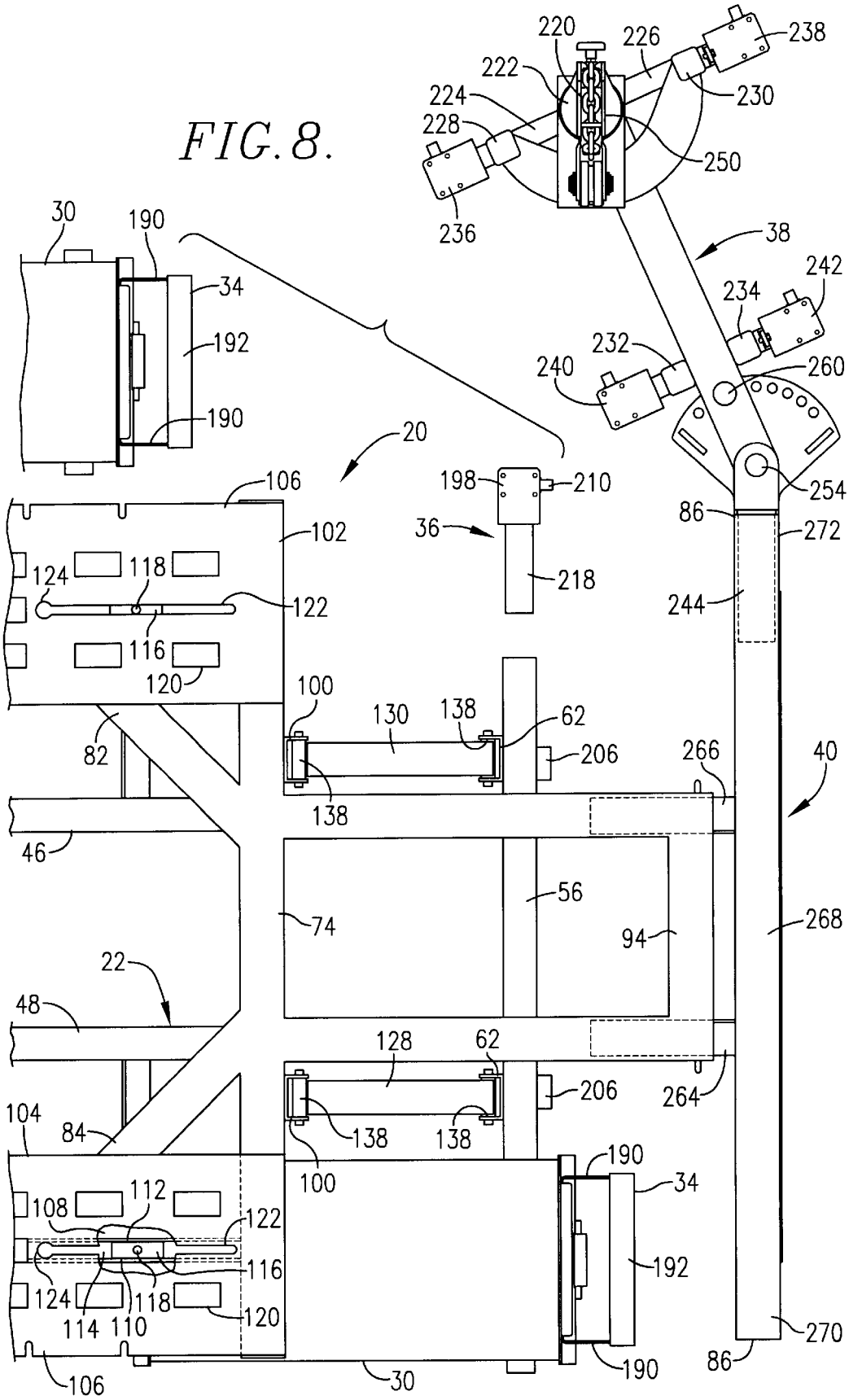
FIG. 8 is an enlarged plan view with portions of the top plate of the deck broken away, showing longitudinally slidable anchor blocks in the interior of the deck, demountable transport wheel assemblies, and a tower coupled to the pulling extension positioned in the front tower mount.

The pulling assembly 38 includes an attachment member 220, a pulling arm 222 coupled to the attachment member 220, a driver 224 which shifts the arm 222 vertically, an arm support 226 on which the arm 222 and the driver 224 are supported, suspension members 228, 230, 232 and 234, corresponding carriage assemblies 236, 238, 240 and 242, and a tongue 244 pivotally coupled to the arm support 226. The attachment member 220 is shown as a chain 246 with a hook 248 for attachment to a body or frame member. The pulling arm 222 is shiftably mounted within the driver 224 which includes an extensible hydraulic ram therein for exerting a pulling force to the attachment member 220, the pulling arm including a holder 250 at the upper end thereof which retains a part of the chain 246 remote from hook 248 as shown in FIGS. 8 and 9. The chain 246 is redirected by pulley assembly 252 which is adjustably mounted to driver 224. The driver 224 is mounted for pivoting about a vertical axis on arm support 226. Link pin 254 connects tongue 244 to a second end 256 of the elongated leg 258 of arm support 226 to permit pivoting about a vertical axis, with lock pin 260 holding the position of the arm support 226 relative to the tongue 244. The leg 258 has a first end 262 positioned adjacent the bottom end of the driver 224. The tongue 244 is configured for insertion into a receiver 86, whereby the pulling assembly 38 may be coupled to the bench 24.

The suspension members 228, 230, 232 and 234 are welded or otherwise secured in a vertical orientation when arm support 226 is in its normal, horizontal orientation. The suspension members each include a spring 264 which is contained therein as shown in FIG. 9 and compressed by the weight of the arm support 226 and the members carried thereby on the carriage assemblies 236, 238, 240 and 242. Preferably, suspension members 228 and 230 are positioned proximate to the first end 262 on either side of the leg 258 as viewed in FIG. 8, and suspension members 232 and 234 are positioned more proximate to the second end 256 than the first end 262, again on either side of the leg 258 as viewed in FIG. 8. The carriage assemblies each include a rotatable wheel which rotates about an axis which is substantially perpendicular to the leg 258. In this manner, the operator may more easily position the tongue 244 into a receiver 86 by applying his weight proximate the first end or pulling on the driver 224 to pivot it in a clockwise direction as viewed in FIG. 2. This causes more weight to be borne by the suspension members 228 and 230 and less weight to be borne by the suspension members 232 and 234, thereby raising the second end 258 to facilitate insertion of the tongue 244 into the receiver 86. After the end of the tongue 244 is in place, the operator may push against the driver 224 in a counterclockwise direction as viewed in FIG. 9. The weight of the arm support and parts carried thereon continues to be supported by all of the suspension members 228, 230, 232 and 234, with an assist in pivoting the driver 224 and therefor in inserting the tongue 244 provided by the suspension members 228 and 230. A pin extends inwardly from the carriage assemblies to contact an outwardly extending stop on the suspension members when the pulling assembly 38 is elevated to prevent the carriage assemblies from dropping free when the pulling assembly 38 is elevated.

In order to provide greater flexibility for different pulling directions, the bench 24 may be provided with an extension 40. The extension 40, as shown in FIG. 8, includes tines 264 and 266 configured complemental to and for receipt within the receivers 86 of channel beams 90 and 92, and bridge 268 extending perpendicular to and outwardly from each of the tines 264 and 266. The bridge presents receivers 86 at each end 270 and 272 thereof which thereby receive the tongue 244 of pulling assembly 38. The bridge 268 is thus located forwardly of the front tube 56 and permits the pulling assembly 38 to be positioned at additional locations for providing precise pulling on the vehicle.

Figure 2:
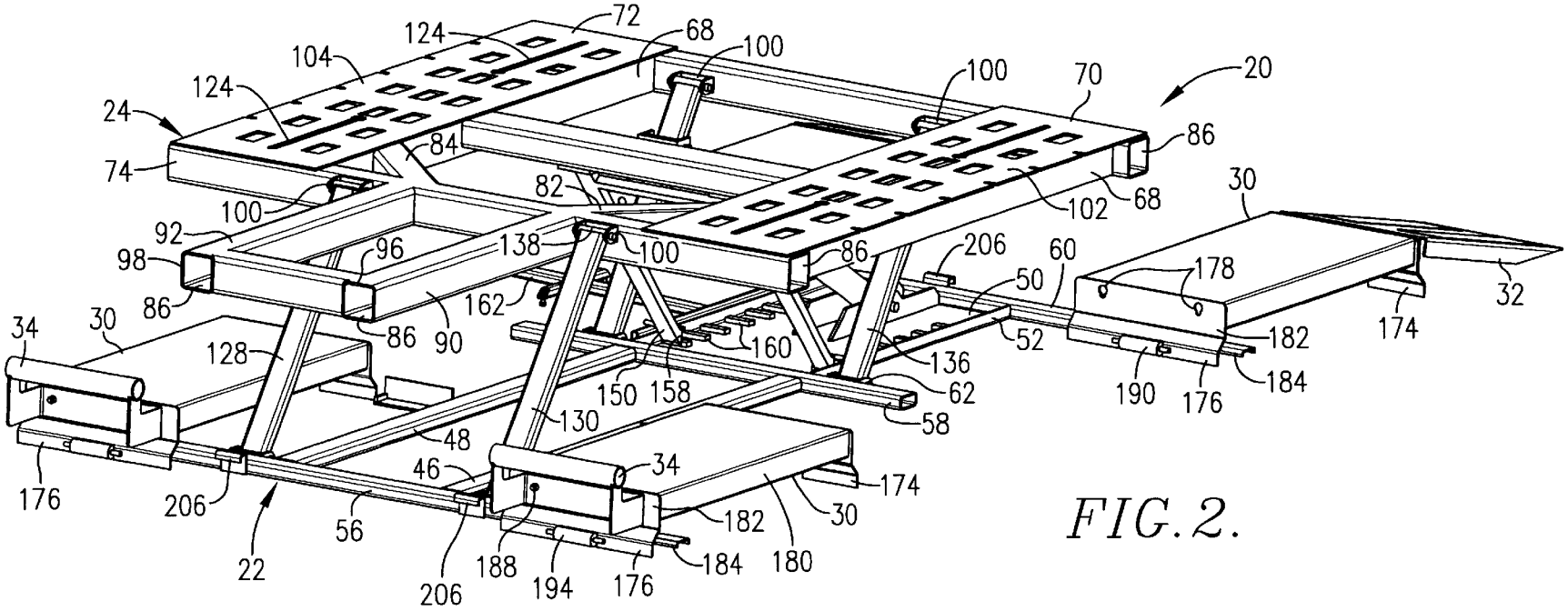
FIG. 2 is a front right perspective view of the platform of the present invention showing the front tower mount and the deck elevated relative to the base.
Figure 3:
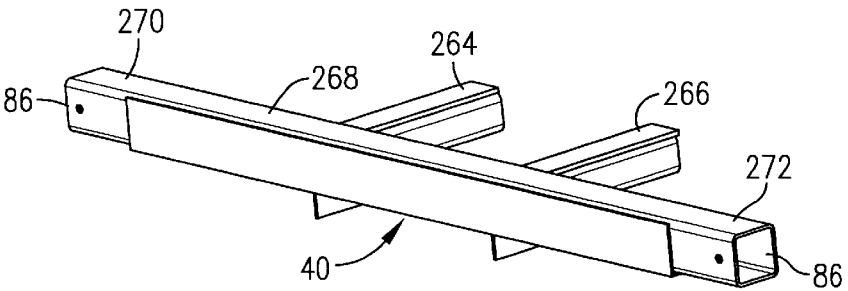
FIG. 3 is a front right perspective view of a pulling extension for attachment to the front tower mount for providing additional locations for attachment of one or more pulling towers.

In use, the platform 20 is positioned within an area sufficiently large to permit a motor vehicle to be placed thereon and for the worker to move about the vehicle during repairs. The power unit 42 may be positioned in any convenient location accessible to a source of electrical power to which it is connected by an extension cord, as its associated hydraulic conduit 146 is of sufficient length to reach the housing unit 142 as shown in FIG. 1. The control 44 includes a switch which may be hand operated when the worker is standing on or near the unlocking member 162, thus enabling one worker to exercise full control over the platform 20 during its raising or lowering.

In preparation for receipt of the vehicle to be repaired, the worker installs the runways 30 as shown in FIG. 1 with the ramps 32 inclined so that a vehicle may be rolled onto the runway 30 from the rear end of the platform 20 and roll forwardly across the treadways until the leading tire is engaged by the chocks 34. By the term leading tire, it is to be understood that the vehicle may be rolled with either its front end facing forwardly or the rear end facing forwardly to permit the most advantageous position for effecting the repair, and thus either the front tire or rear tire may be the leading tire depending on the orientation of the vehicle.

The bench 24 is configured to permit the vehicle to roll thereacross and thus by using the runways 30 and ramps 32, the vehicle readily clears the bench 24. Once the platform 20 is in place and the vehicle positioned so that its wheels are on the runways 30, the pulling assembly 38 is coupled for receipt in one of the receivers 86 of the bench 24 or its extension 40. The control 44 is then actuated to raise the bench 24 above the base 22 until the anchors coupled to the bench 24 are coupled to the vehicle frame. The bench 24 is then further raised until the bench 24 raises the vehicle to a convenient working height. While various repairs may be effected using the platform 20 hereof, it is especially adapted to perform pulling operations on the body and frame of the motor vehicle on the bench 24. To that end, the attachment member 220 is then coupled to the portion of the body or frame to be pulled, and the driver 224 actuated by attachment to the power unit 42 whereby the arm 222 is extended to place tension on the chain and cause the portion of the body or frame to which the hook is attached to be pulled toward the pulling assembly.

In order to lower the bench 24 and thus the vehicle, the worker stands on the foot pedal 166 of the unlocking member 162 while manually actuating the control 44. The application of downward force to the foot pedal 166 causes corresponding upward force to be applied to the trip bar 168, which engages one of the feet 158 and thereby lifts both feet 158 of the lock arm assembly 150 upwardly above the lock teeth 160, permitting the bench 24 to be lowered. This enhances the safety of the operation, as two simultaneous operations must be performed in order to lower the bench 24. The vehicle may then be rolled off of the rear end of the platform 20 after uncoupling the anchors from the vehicle and the bench 24, or forwardly by replacing the chocks 34 with the ramps 32.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A pulling assembly adapted for coupling to an automobile straightening bench, said pulling assembly comprising:

an attachment member adapted for connecting to an automobile;

an arm mounting the attachment member thereon;

an arm support having an elongated leg presenting first and second ends, said arm support including structure for coupling the arm support to the automobile straightening bench;

a driver interconnecting the arm to the arm support for moving the arm relative to the arm support;

a first suspension member connected to the leg proximate said first end and including a tube having a spring therein;

a second suspension member connected to the leg more proximate said second end than said first end and longitudinally spaced therealong from said first suspension member, said second suspension member including a tube having a spring therein;

said first suspension member and said first end of said leg being positioned more proximate said driver than said second suspension member and said second end of said leg;

a first carriage assembly including a wheel coupled to an insert received in said tube of said first suspension member;

a second carriage assembly including a wheel coupled to an insert received in said tube of said second suspension member, whereby said arm support is suspended on said springs for permitting said arm support to be inclined longitudinally with the weight of said arm variably carried by said springs.

2. A pulling assembly as set forth in claim 1, wherein said arm support includes a tubular body telescopically receiving said arm and said driver is mounted in said tubular body for telescopically extending said arm.

3. A pulling assembly as set forth in claim 1, said coupling structure of said arm support including a tongue extending from said second end and adapted for coupling to a tubular channel.

4. A pulling assembly as set forth in claim 3, including a connector pivotally coupling the tongue to said second end.

5. A pulling assembly as set forth in claim 1, wherein said leg has first and second sides, said first suspension member including first and second parallel tubes each having a spring therein and respectively positioned along said first and second sides of said leg, and wherein said first carriage assembly includes first and second laterally spaced and substantially parallel inserts telescopically respectively received in said first and second tubes.

6. A pulling assembly as set forth in claim 5, wherein said leg has first and second sides, said second suspension member including third and fourth parallel tubes each having a spring therein and respectively positioned along said first and second sides of said leg, and wherein said second carriage assembly includes third and fourth laterally spaced and substantially parallel inserts telescopically respectively received in said third and fourth tubes.

7. A pulling assembly as set forth in claim 1, wherein said leg has first and second sides, said second suspension member including a pair of parallel tubes each having a spring therein and respectively positioned along said first and second sides of said leg, and wherein said second carriage assembly includes a pair of laterally spaced and substantially parallel inserts telescopically respectively received in ones of said pair of parallel tubes.

8. A pulling assembly as set forth in claim 1, wherein said first and second suspension members independently support said leg thereon.

9. A pulling assembly adapted for coupling to an automobile straightening bench, said pulling assembly comprising:

an attachment member adapted for connecting to an automobile;

an arm mounting the attachment thereon;

an arm support having an elongated leg presenting first and second ends, said arm support including structure for coupling the arm support to the automobile straightening bench;

a driver in connecting the arm to the arm support for moving the arm relative to the arm support;

a first suspension member connected to the leg proximate said first end;

a second suspension member connected to the leg more approximate said second end than said first end and longitudinally spaced therealong from said first suspension member;

said first suspension member and said first end of said leg being positioned more proximate said driver than said second suspension member and said second end of said leg, the weight of the arm support being carried by the suspension members;

a first carriage assembly including a wheel coupled to said first suspension member, a second carriage assembly including a wheel coupled to said second suspension member, whereby said arm support is suspended on said first and second members for permitting said leg to be independently shifted on said first and second suspension members relative to said first and second carriage assemblies whereby said arm support may be inclined longitudinally with the weight of said arm variably carried by said first and second suspension members.

10. A pulling assembly as set forth in claim 9, wherein said arm support includes a tubular body telescopically receiving said arm and said driver is mounted in said tubular body for telescopically extending said arm.

11. A pulling assembly as set forth in claim 9, said coupling structure of said arm support including a tongue extending from said second and adapted for coupling to a tubular channel.

12. A pulling assembly as set forth in claim 11, including a connector pivotally connecting the tongue to said second end.

13. A pulling assembly as set forth in claim 9, wherein said leg has first and second sides, said first suspension member including first and second parallel tubes each having a resilient load supporting member therein and respectively positioned along said first and second sides of said leg, and wherein said first carriage assembly includes first and second laterally spaced and substantially parallel inserts telescopically received in said first and second tubes.

14. A pulling assembly as set forth in claim 13, wherein said second suspension member includes third and forth parallel tubes each having a resilient load supporting member therein and respectively positioned along said first and second sides of said leg, and wherein said second carriage assembly includes third and fourth laterally spaced and substantially parallel inserts telescopically respectively received in said third and fourth tubes.

15. A pulling assembly as set forth in claim 9, wherein said leg has first and second sides, said second suspension member including a pair of parallel tubes each having a resilient load supporting member therein and respectively positioned along said first and second sides of said leg, and wherein said second carriage assembly includes a pair of laterally spaced and substantially parallel inserts telescopically respectively received in ones of said pair of parallel tubes.

16. A pulling assembly as set forth in claim 9, wherein said first and second suspension members independently support said leg thereon.

* * * * *